US009496672B2

(12) United States Patent
Tanaka

(10) Patent No.: US 9,496,672 B2
(45) Date of Patent: Nov. 15, 2016

(54) CONNECTOR MANUFACTURING METHOD AND CONNECTOR

(71) Applicant: YAZAKI CORPORATION, Minato-ku, Tokyo (JP)

(72) Inventor: Masaki Tanaka, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/976,328

(22) Filed: Dec. 21, 2015

(65) Prior Publication Data

US 2016/0190760 A1 Jun. 30, 2016

(30) Foreign Application Priority Data

Dec. 24, 2014 (JP) ..... 2014-259767

(51) Int. Cl.
*H01R 13/405* (2006.01)
*H01R 43/24* (2006.01)

(52) U.S. Cl.
CPC ..... *H01R 43/24* (2013.01); *H01R 13/405* (2013.01)

(58) Field of Classification Search
CPC .. H01R 43/24; H01R 13/405; H01R 13/504; B29C 45/14639
USPC ..... 439/736
See application file for complete search history.

(56) References Cited

U.S. PATENT DOCUMENTS 2,770,011 A * 11/1956 Kelly ..... B29C 45/2806 249/79
4,588,912 A * 5/1986 Shinmura ..... H02K 29/08 310/43
5,777,851 A * 7/1998 Yamamoto ..... H01R 9/2466 174/251
2009/0186270 A1* 7/2009 Harada ..... H01M 2/0267 429/185

FOREIGN PATENT DOCUMENTS

JP 2011-251494 A 12/2011

* cited by examiner

*Primary Examiner* — Jean F Duverne
(74) *Attorney, Agent, or Firm* — Mots Law, PLLC

(57) ABSTRACT

The connector includes male terminals and a connector housing that is molded using a metal mold. The metal mold includes a cavity for the connector housing and terminal positioning parts which position the male terminals and each of which includes clearance parts that form openings with contact places in the male terminal with a female terminal at the time of insertion or drawing out of the male terminal. The male terminals are positioned in the metal mold by inserting the counterpart-terminal connecting parts into the terminal positioning parts, and resin is filled in the cavity with the male terminals as insert components, and thereafter, the counterpart-terminal connecting parts are drawn out from the terminal positioning parts, and the connector as a molded item is separated from within the metal mold.

2 Claims, 6 Drawing Sheets

CONNECTOR MANUFACTURING METHOD AND CONNECTOR

CROSS REFERENCE TO RELATED APPLICATION

The present application is based on, and claims priority from Japanese Patent Application No. 2014-259767, filed Dec. 24, 2014, the disclosure of which is hereby incorporated by reference herein in its entirety.

BACKGROUND

Technical Field

The present application relates to a connector manufacturing method and a connector in which a connector housing is insert-molded with male terminals as insert components.

Related Art

As a conventional connector, one described in JP 2011-251494A is proposed. The conventional connector includes male terminals to be connected with female terminals of a counterpart connector and a connector housing which is insert-molded with the male terminals as the insert components.

As a manufacturing method of such a connector, various methods have been proposed. As one of the connector manufacturing methods of a conventional example, there is one as illustrated in FIGS. 1 to 3. In the connector manufacturing method of this conventional example, a metal mold 120 includes a cavity (not illustrated) for a connector housing 110 and a terminal positioning part 121 that positions male terminals 101 of the connector 100.

With, the above structure, when arranging the male terminals 101 at predetermined positions relative to the metal mold 120, counterpart-terminal connecting parts 102 of the male terminals 101 are inserted into the terminal positioning part 121 of the metal mold 120, and the male terminals 101 are positioned in the metal mold 120 by abutting the entire outer peripheral surfaces of the counterpart-terminal connecting parts 102. Subsequently, after resin is filled within the cavity formed between the metal mold 120 and the male terminals 101 with the male terminals 101 as the insert components, the counterpart-terminal connecting parts 102 are drawn out from the terminal positioning part 121 and the molded item is separated from within the metal mold 120.

SUMMARY

In the connector manufacturing method of the conventional example, the terminal positioning part 121 of the metal mold 120 abuts the entire outer peripheral surfaces of the counterpart-terminal connecting parts 102 of the male terminals 101 for positioning. Therefore, when inserting the counterpart-terminal connecting parts 102 of the male terminals 101 into the terminal positioning part 121 or when drawing out the counterpart-terminal connecting parts 102 of the male terminals 101 from the terminal positioning part 121, the terminal positioning part 121 slides on the entire outer peripheral surfaces of the male terminals 101. Therefore, there is a possibility that scratches 103 are formed on contact places of the counterpart-terminal connecting parts 102 with female terminals 130 due to the sliding of the terminal positioning part 121.

The present application considers the above circumstances and aims to provide a connector manufacturing method and a connector which can prevent a contact place of a male terminal with a counterpart female terminal from being damaged, and which can keep an electrical contact resistance between the male terminal and the counterpart female terminal within a predetermined range.

A connector manufacturing method according to a first aspect of the present application includes: a terminal setting step positioning a male terminal in a metal mold by inserting a counterpart-terminal connecting part of the male terminal into a terminal positioning part of the metal mold, the metal mold including a cavity for a connector housing and the terminal positioning part that positions the male terminal, the terminal positioning part including a clearance part that forms an opening with a contact place with a female terminal of a counterpart connector at the time of insertion or drawing out of the male terminal; a resin filling step filling resin in the cavity with the male terminal as an insert component; and a molded item takeout step, after the resin filling step, drawing out the counterpart-terminal connecting part from the terminal positioning part and separating a molded item from within the metal mold.

A connector according to a second aspect of the present application includes a male terminal including a counterpart-terminal connecting part which is to be connected with a female terminal of a counterpart connector, and a connector housing that is insert-molded with the male terminal as an insert component. A metal mold for molding the connector housing includes a cavity for the connector housing and a terminal positioning part that positions the male terminal. The terminal positioning part includes a clearance part that forms an opening with a contact place with the female terminal at the time of insertion or drawing out of the male terminal. The connector is manufactured by a terminal setting step positioning the male terminal in the metal mold by inserting the counterpart-terminal connecting part into the terminal positioning part; a resin filling step filling resin in the cavity with the male terminal as an insert component; and a molded item takeout step, after the resin filling step, drawing out the counterpart-terminal connecting part from the terminal positioning part and separating a molded item from within the metal mold.

According to the present application, since the terminal positioning part includes the clearance part that forms an opening with a contact place with the female terminal at the time of insertion or drawing out of the male terminal, the contact place of the male terminal which comes into contact with the female terminal does not become damaged due to the sliding in the process of insertion of the male terminal into the terminal positioning part or drawing out of the male terminal from the terminal positioning part. Therefore, it is possible to keep the electrical contact resistance between the male terminal and the counterpart female terminal within a predetermined range.

DETAILED DESCRIPTION

Figure 1:
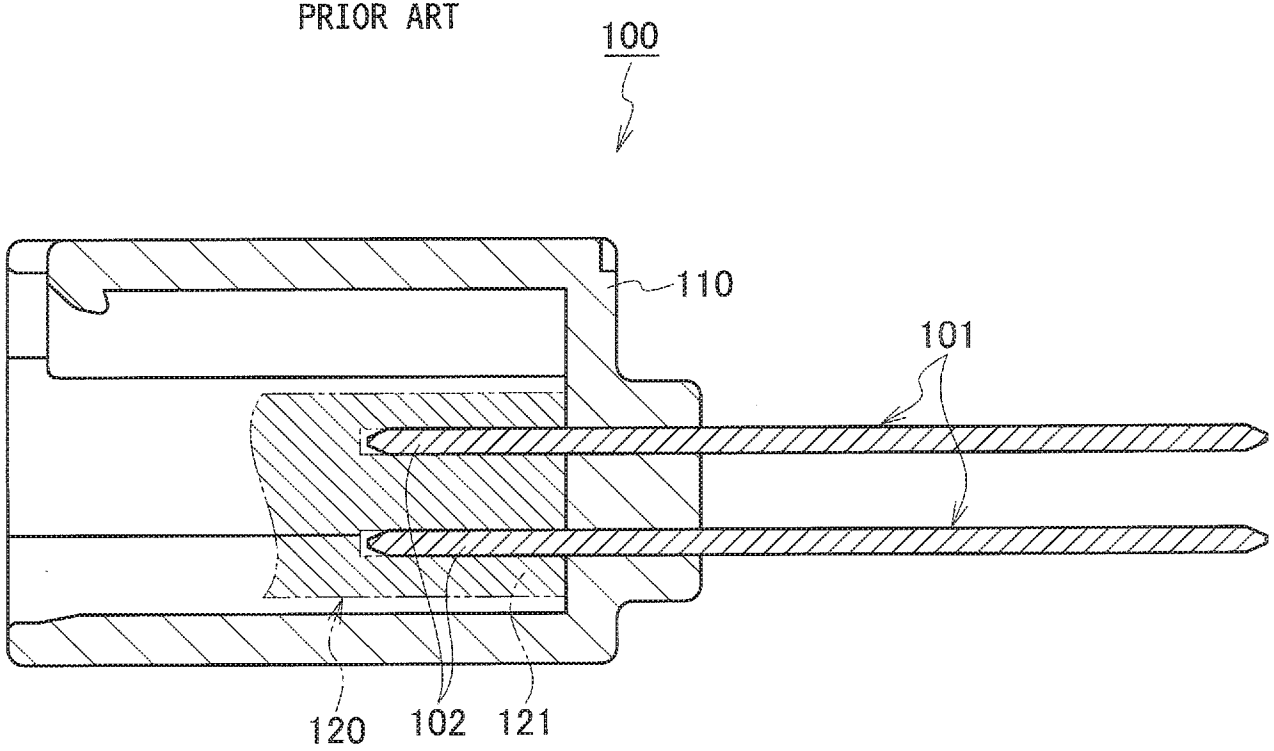
FIG. 1 PRIOR ART
FIG. 1 is a cross-sectional view of a connector according to a conventional example.
Figure 2A:
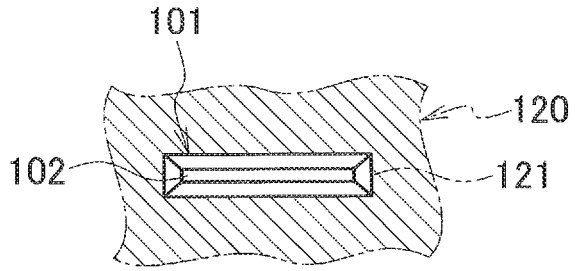
FIG. 2A PRIOR ART
FIG. 2A is a front view of a male terminal of the connector according to the conventional example seen from forward.
Figure 2B:
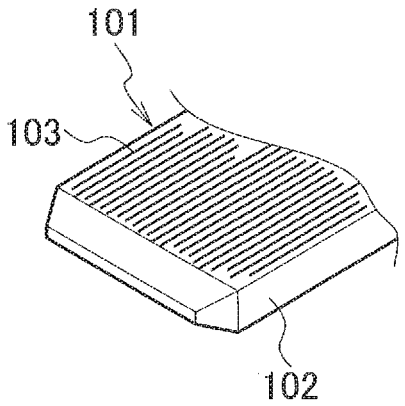
FIG. 2B PRIOR ART
FIG. 2B is a perspective view of the male terminal of the connector according to the conventional example seen from the upper surface side.
Figure 3A:
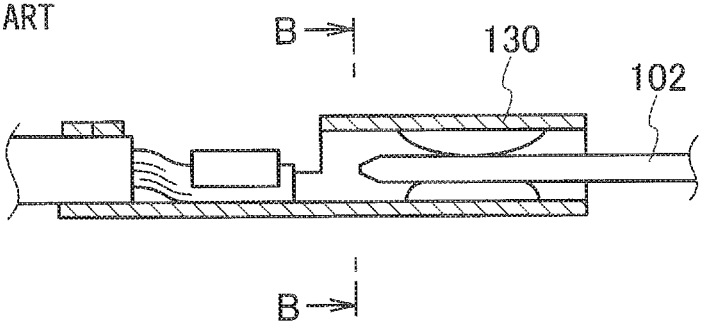
FIG. 3A PRIOR ART
FIG. 3A is a cross-sectional view explaining a fitting state of the male terminal of the connector according to the conventional example and a counterpart female terminal.
Figure 3B:
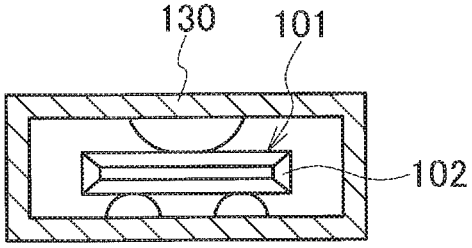
FIG. 3B PRIOR ART
FIG. 3B is a cross-sectional view taken along line B-B of FIG. 3A.

A connector according to an embodiment will be explained by referring to FIGS. 4, 5A-5C, 6A, and 6B.

A connector 1 according to the embodiment is provided to extend in the direction from front to rear (horizontal direction of FIG. 4) and includes a plurality of male terminals 2 arranged to maintain a predetermined distance with each other, and a connector housing 10 made of synthetic resin which is insert-molded with each of the male terminals 2 as an insert component. The connector housing 10 is provided to extend in the direction from front to rear, and is integrally composed of a peripheral wall part 11 of a generally rectangular cylindrical shape having a forward opening and a rear wall part 12 provided to cover the rear end of the peripheral wall part 11.

Each of the male terminals 2 is formed of a long narrow metal plate. Each of the male terminals 2 includes a counterpart-terminal connecting part 3 that passes through the rear wall part 12 and protrudes forward from the rear wall part 12. The counterpart-terminal connecting part 3 is connected with a corresponding female terminal 20 of a counterpart connector.

Figure 6A:
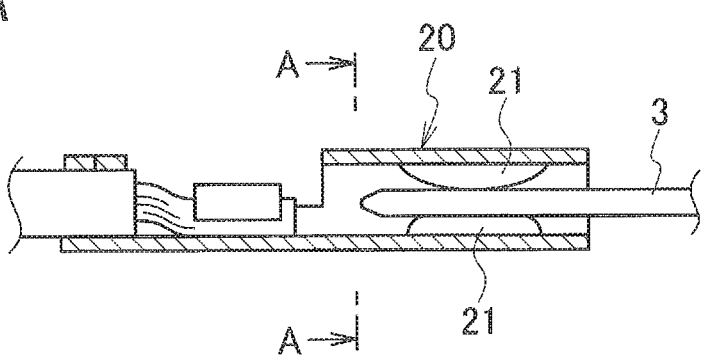
FIG. 6A is a cross-sectional view explaining a fitting state of the male terminal of the connector according to the embodiment and a counterpart female terminal.
Figure 6B:
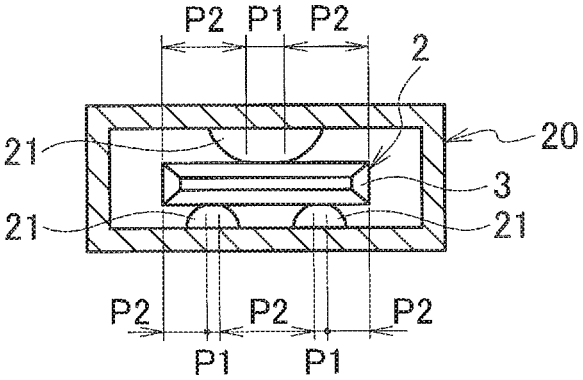
FIG. 6B is a cross-sectional view taken along line A-A of FIG. 6A.

When a connector housing (not illustrated) of the counterpart connector is inserted into the connector housing 10 from the front side, and the female terminals 20 of the counterpart connector are fitted with the male terminals 2 as illustrated in FIGS. 6A and 6B, each contact part 21 of the female terminals 20 comes into contact with a corresponding contact place P1 of the male terminals 2 by Which the male terminals 2 and the female terminals 20 are electrically connected. On the other hand, another place P2 of each of the male terminals 2 does not come into contact with the contact part 21 of each of the female terminals 20.

Figure 4:
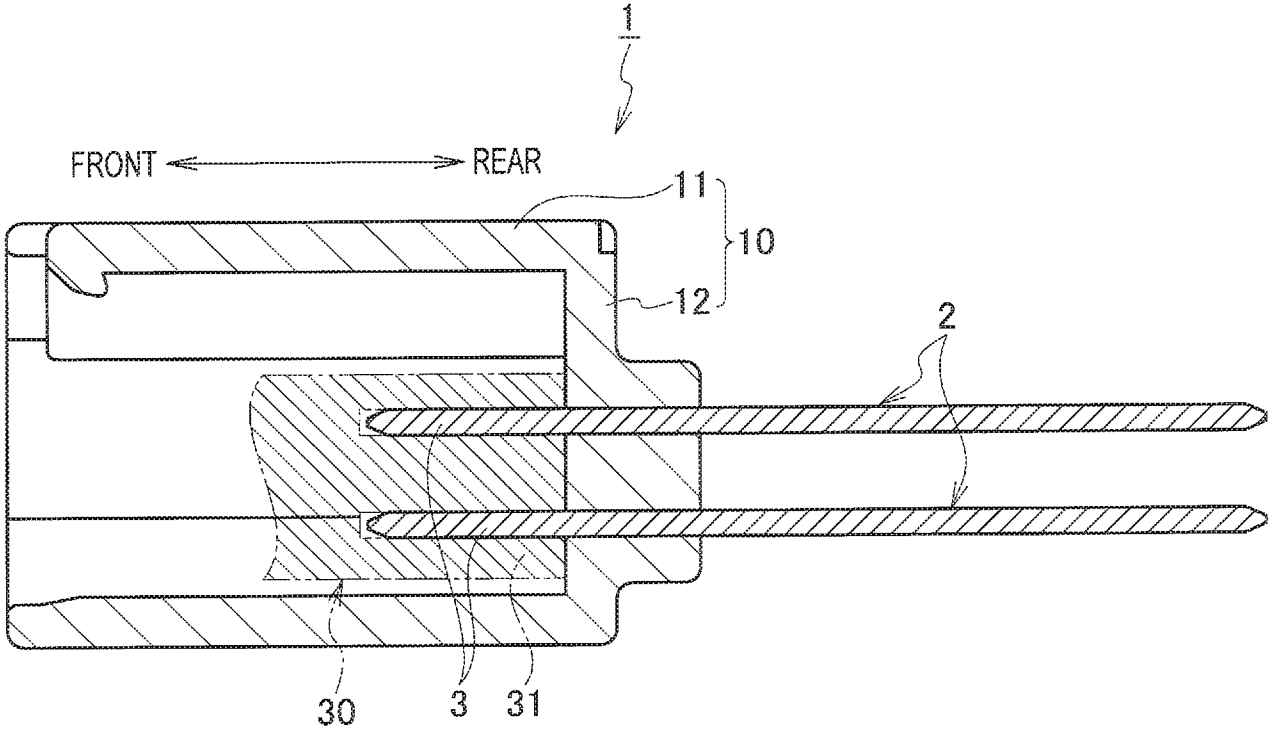
FIG. 4 is a cross-sectional view of a connector according to an embodiment.
Figure 5A:
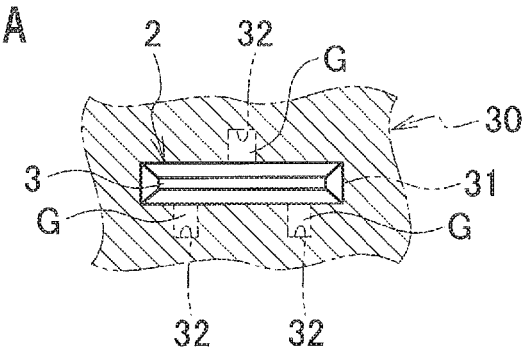
FIG. 5A is a front view of a male terminal of the connector according to the embodiment seen from forward.
Figure 5B:
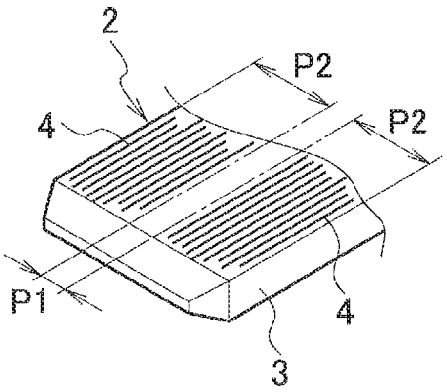
FIG. 5B is a perspective view of a principal part of the male terminal of the connector according to the embodiment seen from the upper surface side.
Figure 5C:
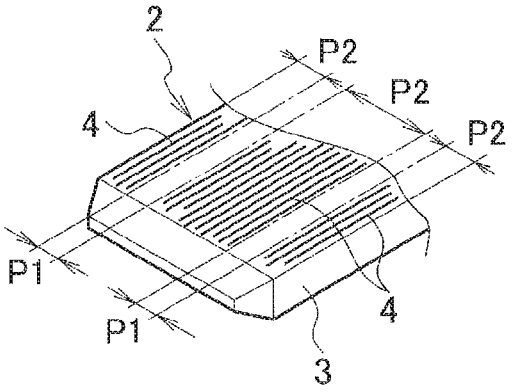
FIG. 5C is a perspective view of a principal part of the male terminal of the connector according to the embodiment seen from the downward side.

At the time of manufacturing the connector 1 according to the embodiment, a metal mold 30 as illustrated in FIGS. 4 and 5A is used. The metal mold 30 includes a cavity (not illustrated) for the connector housing 10 and terminal positioning parts 31 that position the male terminals 2. The male terminals 2 are positioned in the metal mold 30 by inserting the counterpart-terminal connecting parts 3 of the male terminals 2 into the terminal positioning parts 31. At each of the terminal positioning parts 31, as illustrated in FIG. 5A, clearance parts 32 that form openings G with the contact place P1 with the female terminal 20 at the time of insertion or drawing out of the male terminal 2 are provided.

With the above structure, when manufacturing the connector 1, first as a terminal setting process, as illustrated in FIGS. 4 and 5A, the counterpart-terminal connecting parts 3 of the male terminals 2 are inserted into the terminal positioning parts 31 of the metal mold 30, thus the male terminals 2 are positioned in the metal mold 30. Subsequently, as a resin filling process, resin is filled in the cavity of the metal mold 30, and the connector housing 10 is insert-molded with the male terminals 2 as the insert components. After the resin filling process is thus completed, as a molded item takeout process, the counterpart-terminal connecting parts 3 of the male terminals 2 are drawn out from the terminal positioning parts 31 of the metal mold 30, and the connector 1 as the molded item is separated from within the metal mold 30.

As described above, according to the embodiment, at the terminal positioning part 31 of the metal mold 30, by the clearance parts 32 the openings G are formed with the contact place P1 of the male terminal 2 which comes into contact with the female terminal 20. Therefore, the contact place P1 of the male terminal 2 which comes into contact with the female terminal 20 does not become damaged due to the sliding in the process of insertion of the male terminal 2 into the terminal positioning part 31 or in the process of drawing out of the male terminal 2 from the terminal positioning part 31. Accordingly, since a flat contact surface is formed at the contact place P1 of the male terminal 7, it is possible to keep the electrical contact resistance between the male terminal 2 and the counterpart female terminal 20 within a predetermined range. Further, since the terminal positioning part 31 of the metal mold 30 comes into contact with the other place P2 of the male terminal 2 which does not come into contact with the contact part 21 of the female terminal 20, there is a possibility that scratches 4 that extend in the sliding direction (the direction from front to rear) are formed on the other place P2 due to the sliding of the terminal positioning part 31.

What is claimed is:

1. A connector manufacturing method, comprising:

a terminal setting step positioning a male terminal in a metal mold by inserting a counterpart-terminal connecting part: of the male terminal into a terminal positioning part of the metal mold, the metal mold including a cavity for a connector housing and the terminal positioning part that positions the male terminal, the terminal positioning part including a clearance part that forms an opening with a contact place with a female terminal of a counterpart connector at the time of insertion or drawing out of the male terminal;

a resin filling step filling resin in the cavity with the male terminal as an insert component; and a molded item takeout step, after the resin filling step, drawing out the counterpart-terminal connecting part from the terminal positioning part and separating a molded item from within the metal mold.

2. A connector, comprising:

a male terminal including a counterpart-terminal connecting part which is to be connected with a female terminal of a counterpart connector; and a connector housing that is insert-molded with the male terminal as an insert component, wherein a metal mold for molding the connector housing includes a cavity for the connector housing and a terminal positioning part that positions the male terminal, the terminal positioning part includes a clearance part that forms an opening with a contact place with the female terminal at the time of insertion or drawing out of the male terminal;

the connector is manufactured by:

a terminal setting step positioning the male terminal in the metal mold by inserting the counterpart-terminal connecting part into the terminal positioning part;

a resin filling step filling resin in the cavity with the male terminal as an insert component; and a molded item takeout step, after the resin filling step, drawing out the counterpart-terminal connecting part from the terminal positioning part and separating a molded item from within the metal mold.

* * * * *